US011342133B1

(12) United States Patent
Chang et al.

(10) Patent No.: US 11,342,133 B1
(45) Date of Patent: May 24, 2022

(54) KEY STRUCTURE

(71) Applicant: Primax Electronics Ltd., Taipei (TW)

(72) Inventors: Sheng-Fan Chang, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/211,656

(22) Filed: Mar. 24, 2021

(30) Foreign Application Priority Data

Feb. 25, 2021 (TW) ..... 110106769

(51) Int. Cl.
*H01H 3/12* (2006.01)
*H01H 13/02* (2006.01)

(52) U.S. Cl.
CPC ..... *H01H 3/12* (2013.01); *H01H 13/02* (2013.01); *H01H 2223/054* (2013.01)

(58) Field of Classification Search
CPC .... H01H 3/12; H01H 13/02; H01H 2223/054; H01H 2227/022; H01H 2221/036; H01H 2221/044
USPC ..... 200/5 A, 344, 341, 345
See application file for complete search history.

(56) References Cited

U.S. PATENT DOCUMENTS 4,952,761 A * 8/1990 Viebrantz ..... H01H 13/702 200/43.01
8,624,140 B2 * 1/2014 Nishino ..... H01H 13/702 200/302.2

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A key structure includes a circuit board, a triggering part and an elastic element. The elastic element includes an upper support portion, a lower support portion, an upper elastic portion and a lower elastic portion. The lower support portion is located beneath the upper support portion and connected to a peripheral region of the circuit board. The upper elastic portion is connected between the triggering part and the upper support portion. The lower elastic portion is connected between the upper support portion and the lower support portion. The lower elastic portion includes a first section and a second section connected to each other. The first section is connected to the upper support portion. The second section is connected to the lower support portion. There is a vacant space between the second section and the circuit board.

11 Claims, 3 Drawing Sheets

KEY STRUCTURE

FIELD OF THE INVENTION

The present invention relates to a key structure, and more particularly to a key structure without a scissors-type connecting element.

BACKGROUND OF THE INVENTION

In modern societies, electronic devices become indispensable parts in human lives. The electronic products are applied in many sectors, including food, clothing, housing, transportation, education and entertainment. For facilitating the users to carry and use electronic products, the trends of designing electronic products are toward light weightiness and slimness.

Generally, an electronic product is equipped with keys. Conventionally, a key comprises a scissors-type connecting element and an elastic element. However, since the travel distance of the key with the scissors-type connecting element is restricted by the volume of the elastic element, it is usually unable to allow the key to have a low travel distance less than or equal to 1 mm.

Therefore, there is a need of providing an improved key structure in order to overcome the drawbacks of the conventional technologies.

SUMMARY OF THE INVENTION

In accordance with an aspect of the present invention, a key structure is provided. The key structure includes a circuit board, a triggering part and an elastic element. The circuit board includes a switch and a peripheral region. The peripheral region is located adjacent to the switch. The triggering part is aligned with the switch. The elastic element includes an upper support portion, a lower support portion, an upper elastic portion and a lower elastic portion. The lower support portion is located beneath the upper support portion and connected to the peripheral region of the circuit board. The upper elastic portion is connected between the triggering part and the upper support portion. The lower elastic portion is connected between the upper support portion and the lower support portion. The lower elastic portion includes a first section and a second section connected to each other. An angle between the first section and the second section is larger than 120 degrees and smaller than 180 degrees. The first section is connected to the upper support portion. The second section is connected to the lower support portion. There is a vacant space between the second section and circuit board.

In an embodiment, an upper space is defined by the triggering part, the upper elastic portion and the upper support portion collaboratively. In addition, a lower space is defined by the triggering part, the upper elastic portion, the first section of the lower elastic portion, a bottom surface of the second section of the lower elastic portion and an inner surface of the lower support portion collaboratively.

In an embodiment, an angle between the upper elastic portion and the lower elastic portion is larger than 45 degrees and smaller than 90 degrees.

In an embodiment, the lower elastic portion is thinner than the upper elastic portion.

In an embodiment, the first section of the lower elastic portion is thinner than the second section of the lower elastic portion.

In an embodiment, an angle between the second section of the lower elastic portion and the lower support portion is larger than or equal to 90 degrees and smaller than 180 degrees.

In an embodiment, the key structure further includes a keycap. While the keycap is pressed down, the lower space is compressed, and the first section of the lower elastic portion is subjected to deformation and protruded externally.

In an embodiment, the key structure further includes a keycap. While the keycap is pressed down, the second section of the lower elastic portion is subjected to deformation and moved toward the circuit board.

In an embodiment, a first end of the upper elastic portion is connected to the upper support portion, and a second end of the upper elastic portion is connected to the triggering part. The first end of the upper elastic portion is thicker than the second end of the upper elastic portion.

In an embodiment, there is a distance between the second section of the lower elastic portion and the circuit board, and a ratio of the distance to a length of the second section is in a range between 1:4 and 2:1.

In an embodiment, both of the first section and the second section of the lower elastic portion are linear.

According to the present invention, the elastic element is configured to replace the scissors-type connecting element of the conventional key structure. Due to the special design, the key structure of the present invention provides a low travel distance that is less than or equal to 1 mm. Moreover, since both of the first section and the second section of the lower elastic portion can provide the travel distance, the travel distance of the key structure is not too small to provide a sufficient touch feeling for the user. Even if the overall thickness of the key structure or the thickness of the elastic element is very small, the key structure of the present invention can provide the sufficient travel distance. In other words, the key structure of the present invention can meet today's requirements.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

As mentioned above, since the travel distance of the conventional key with the scissors-type connecting element is restricted by the volume of the elastic element, it is unable to allow the key to have the low travel distance less than or equal to 1 mm. It is a technical subject of the present invention to provide a key structure with the travel distance that is less than or equal to 1 mm. Therefore, how to make the key structure have a travel distance less than or equal to 1 mm and provide a sufficient touch feeling becomes a technical issue in this field. Accordingly, the present invention provides a key structure in order to overcome the drawbacks of the conventional technologies. Some embodiments of the key structure of the present invention will be described as follows.

Figure 1:
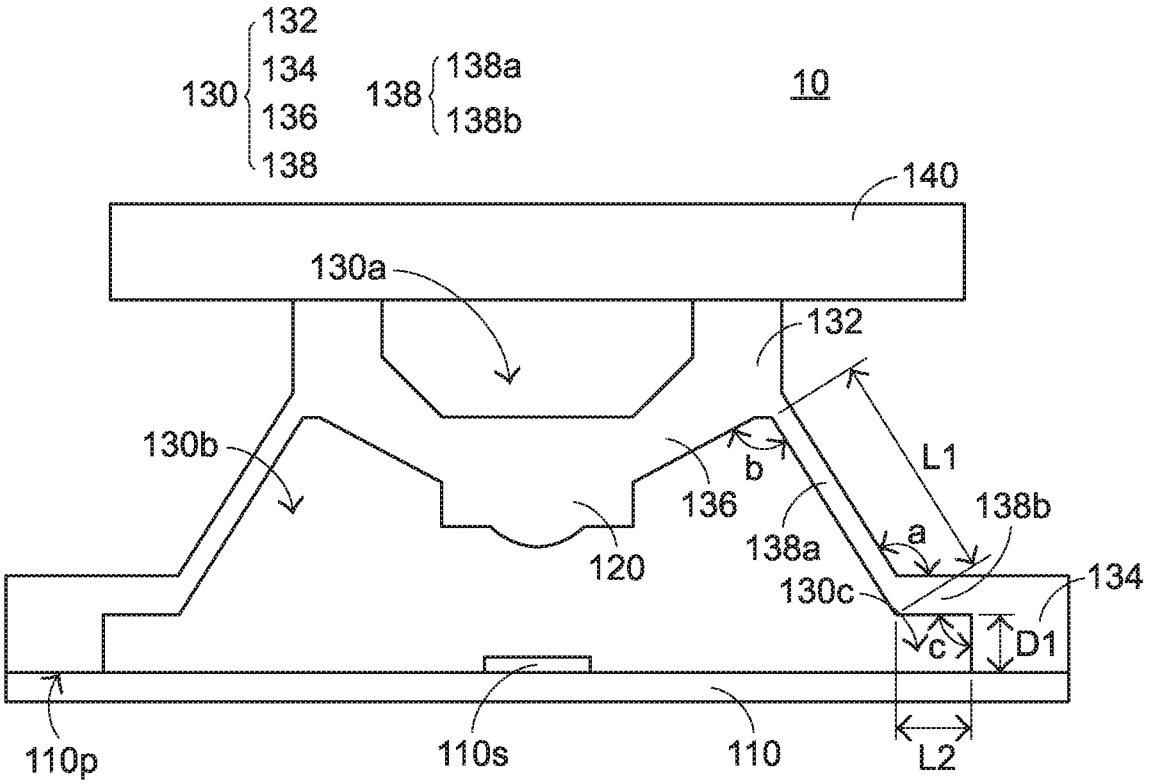
FIG. 1 is a schematic cross-sectional view illustrating a key structure according to an embodiment of the present invention.

FIG. 1 is a schematic cross-sectional view illustrating a key structure according to an embodiment of the present invention. As shown in FIG. 1, the key structure 10 comprises a circuit board 110, a triggering part 120 and an elastic element 130. In some embodiments, the key structure 10 further comprises a keycap 140. The keycap 140 is located over the elastic element 130 and in contact with a portion of the elastic element 130. In some embodiments, the elastic element 130 is configured to replace the scissors-type connecting element of the conventional key structure. That is, the key structure 10 of the present invention is not equipped with the scissors-type connecting element. Due to the special design, the travel distance of the key structure 10 can be less than or equal to 1 mm.

The circuit board 110 comprises a switch 110*s* and a peripheral region 110*s*. The peripheral region 110*s* is located adjacent to the switch 110*s*. From the top view, the peripheral region 110*p* is arranged around the switch 110*s*. In the embodiment of FIG. 1, the switch 110*s* is protruded from a top surface of the circuit board 110. It is noted that numerous modifications and alterations may be made while retaining the teachings of the invention. For example, in another embodiment, the switch is embedded in the circuit board. In addition, the top surface of the switch is exposed outside and coplanar with the top surface of the circuit board.

The position of the triggering part 120 corresponds to the position of the switch 110*s*. That is, the triggering part 120 is aligned with the switch 110*s*. While the keycap 140 of the key structure 10 is pressed down, the triggering part 120 is gradually moved downwardly and then in contact with the switch 110*s* of the circuit board 110. In some embodiments, the triggering part 120 is made of elastic material. Consequently, when the keycap 140 is pressed down to the bottom, the triggering part 120 (e.g., a lower end of the triggering part 120) is subjected to deformation.

The elastic element 130 is made of elastic material. For example, the elastic material is rubber or any other appropriate material with elasticity. In some embodiments, the triggering part 120 and the elastic element 130 are integrally formed as a one-piece structure, and the triggering part 120 and the elastic element 130 are made of conductive rubber. In some embodiments, the overall thickness (or the overall height) of the elastic element 130 is in the range between 1.5 mm and 2.1 mm, e.g., 1.6 mm, 1.7 mm, 1.8 mm, 1.9 mm or 2.0 mm. In other words, the key structure 10 with the elastic element 130 is very slim.

The elastic element 130 comprises an upper support portion 132, a lower support portion 134, an upper elastic portion 136 and a lower elastic portion 138. In some embodiments, the upper support portion 132 is connected to the keycap 140. In some embodiments, the top surface of the upper support portion 132 is connected to the bottom surface of the keycap 140. In some embodiments, the top surface of the upper support portion 132 is located at a level higher than the top surface of the triggering part 120.

The lower support portion 134 is located beneath the upper support portion 132. The lower support portion 134 is connected to the peripheral region 110*p* of the circuit board 110. In some embodiments, the bottom surface of the lower support portion 134 is located at a level lower than the bottom surface of the triggering part 120.

The upper elastic portion 136 is connected between the triggering part 120 and the upper support portion 132. In some embodiments, an upper space 130*a* is defined by the triggering part 120, the upper elastic portion 136 and the upper support portion 132 collaboratively. As shown in FIG. 1, a first end of the upper elastic portion 136 is connected to the upper support portion 132, and a second end of the upper elastic portion 136 is connected to the triggering part 120. In an embodiment, the first end of the upper elastic portion 136 is thicker than the second end of the upper elastic portion 136. It is noted that numerous modifications and alterations may be made while retaining the teachings of the invention. For example, in another embodiment, the thickness of the upper elastic portion 136 is uniform. That is, the thickness of the first end of the upper elastic portion (i.e., the end connected to the upper support portion) and the second end of the upper elastic portion (i.e., the end connected to the triggering part) are equal.

The lower elastic portion 138 is connected between the upper support portion 132 and the lower support portion 134. In some embodiments, the angle b between the upper elastic portion 136 and the lower elastic portion 138 is larger than 45 degrees and smaller than 90 degrees. For example, the angle b is 50 degrees, 55 degrees, 60 degrees, 65 degrees, 70 degrees, 75 degrees, or 85 degrees. It is noted that the degree of the angle b is not restricted. In some embodiments, the length of the lower elastic portion 138 is larger than the length of the upper elastic portion 136. In some embodiments, the thickness of the lower elastic portion 138 is smaller than the thickness of the upper elastic portion 136. While the keycap 140 is pressed down, the lower elastic portion 138 is subjected to deformation firstly, and then the upper elastic portion 136 is subjected to deformation.

The lower elastic portion 138 comprises a first section 138*a* and a second section 138*b*. The first section 138*a* and the second section 138*b* are connected to each other. The first section 138*a* is connected to the upper support portion 132. The second section 138*b* is connected to the lower support portion 134. In some embodiments, the first section 138*a* and the second section 138*b* of the lower elastic portion 138 are linear or curved, but not bent. In the embodiment of FIG. 1, both of the first section 138*a* and the second section 138*b* of the lower elastic portion 138 are linear.

The angle a between the first section 138*a* and the second section 138*b* of the lower elastic portion 138 is larger than 120 degrees and smaller than 180 degrees. For example, the angle a is 122 degrees, 125 degrees, 130 degrees, 135 degrees, 140 degrees, 145 degrees, 150 degrees, 155 degrees, 160 degrees, 165 degrees, 170 degrees, or 175 degrees. It is noted that the degree of the angle a is not restricted.

The angle c between the second section 138*b* of the lower elastic portion 138 and the lower support portion 134 is larger than 90 degrees and smaller than 180 degrees. For example, the angle c is 95 degrees, 100 degrees, 105 degrees, 110 degrees, 115 degrees, 120 degrees, 125 degrees, 130 degrees, 135 degrees, 140 degrees, 145 degrees, 150 degrees, 155 degrees, 160 degrees, 165 degrees, 170 degrees, or 175 degrees. It is noted that the degree of the angle c is not restricted.

In the embodiment of FIG. 1, each of the first section 138*a* and the second section 138*b* of the lower elastic portion 138 has a uniform thickness. It is noted that numerous modifications and alterations may be made while retaining the teachings of the invention. For example, in another embodiment, the thickness of each of the first section and the second section of the lower elastic portion 138 is not uniform. This situation is similar to that of the upper elastic portion 136.

In some embodiments, both of the first section 138*a* and the second section 138*b* of the lower elastic portion 138 are thinner than the upper elastic portion 136. In some embodiments, the first section 138*a* is thinner than the second section 138*b*.

In some embodiments, the length L1 of the first section 138*a* is larger than the length L2 of the second section 138*b*. In some embodiments, the ratio of the length L1 of the first section 138*a* to the length L2 of the second section 138*b* is in the range between 2:1 and 5:1. For example, the ratio is 3:1 or 4:1. Please refer to FIG. 1 again. A first end of the first section 138*a* is connected to the upper support portion 132. A second end of the first section 138*a* is connected to the second section 138*b*. In this context, the length L1 of the first section 138*a* is the distance between the inside of the first end of the first section 138*a* and the inside of the second end of the first section 138*a*. Similarly, a first end of the second section 138*b* is connected to the first section 138*a*, and a second end of the second section 138*b* is connected to the lower support portion 134. In this context, the length L2 of the second section 138*b* is the distance between the inside of the first end of the second section 138*b* and the inside of the second end of the second section 138*b*.

In the embodiment of FIG. 1, the second section 138*b* of the lower elastic portion 138 and circuit board 110 (e.g., the top surface of the circuit board 110) are substantially parallel to each other. The term "substantially parallel" described herein indicates that the second section 138*b* of the lower elastic portion 138 and the circuit board 110 are completely parallel to each other or the parallel deviation between the second section 138*b* of the lower elastic portion 138 and the circuit board 110 is within ±5°. Especially, there is a vacant space 130*c* between the second section 138*b* of the lower elastic portion 138 and circuit board 110. In addition, there is a distance D1 between the second section 138*b* of the lower elastic portion 138 and the circuit board 110. In some embodiments, the ratio of the distance D1 to the length L2 of the second section 138*b* is in the range between 1:4 and 2:1. For example, the ratio is 1:3, 1:2.5, 1:2, 1:1.5, 1:1, or 1.5:1. It is noted that the ratio is not restricted. In some embodiments, a lower space 130*b* is defined by the triggering part 120, the upper elastic portion 136, the first section 138*a*, the bottom surface of the second section 138*b* and the inner surface of the lower support portion 134 collaboratively.

Some embodiments of the operations of the key structure 10 will be described as follows. In an embodiment, while the keycap 140 is pressed down, the lower space 130*b* is firstly compressed to provide a first portion of the travel distance of the key structure, and the upper space 130*a* is then compressed to provide a second portion of the travel distance of the key structure. In another embodiment, while the keycap 140 is pressed down, the lower space 130*b* is compressed, and the first section 138*a* of the lower elastic portion 138 is subjected to deformation and protruded externally. In another embodiment, while the keycap 140 is pressed down, the lower space 130*b* is compressed, and the second section 138*b* of the lower elastic portion 138 is subjected to deformation and moved toward the circuit board 110. In another embodiment, while the keycap 140 is pressed down, the lower space 130*b* is compressed. In addition, the first section 138*a* of the lower elastic portion 138 is firstly subjected to deformation and protruded externally to provide a first stage of the travel distance of the key structure 10, and then the second section 138*b* of the lower elastic portion 138 is subjected to deformation and moved toward the circuit board 110 to provide a second stage of the travel distance of the key structure 10.

For example, in a variant example of the key structure, the lower elastic portion 138 is equipped with the first section 138*a* only (i.e., without the second section 138*b*), and the first section 138*a* of the lower elastic portion is directly connected to the lower support portion 134. However, in case that the lower elastic portion 138 is additionally equipped with the second section 138*b*, the volume of the lower space in the key structure 10 is relatively larger in order to facilitate the increase of the travel distance of the key structure. In other words, the arrangement of the second section 138*b* of the lower elastic portion 138 is helpful to increase the travel distance of the key structure 10.

FIGS. 2A to 2D schematically illustrate operations of the key structure according to an embodiment of the present invention.

Figure 2A:
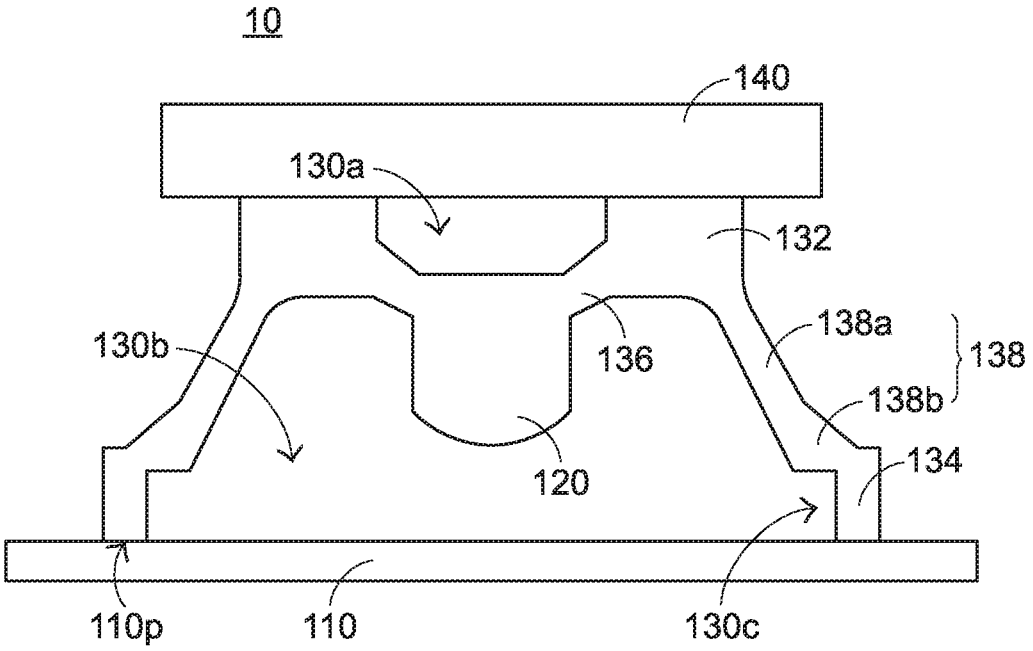
FIGS. 2A to 2D schematically illustrate the operations of the key structure according to an embodiment of the present invention.

Please refer to FIG. 2A. When the keycap 140 is not pressed down, each of the upper space 130*a* and the lower space 130*b* of the key structure 10 has a certain volume.

Figure 2B:
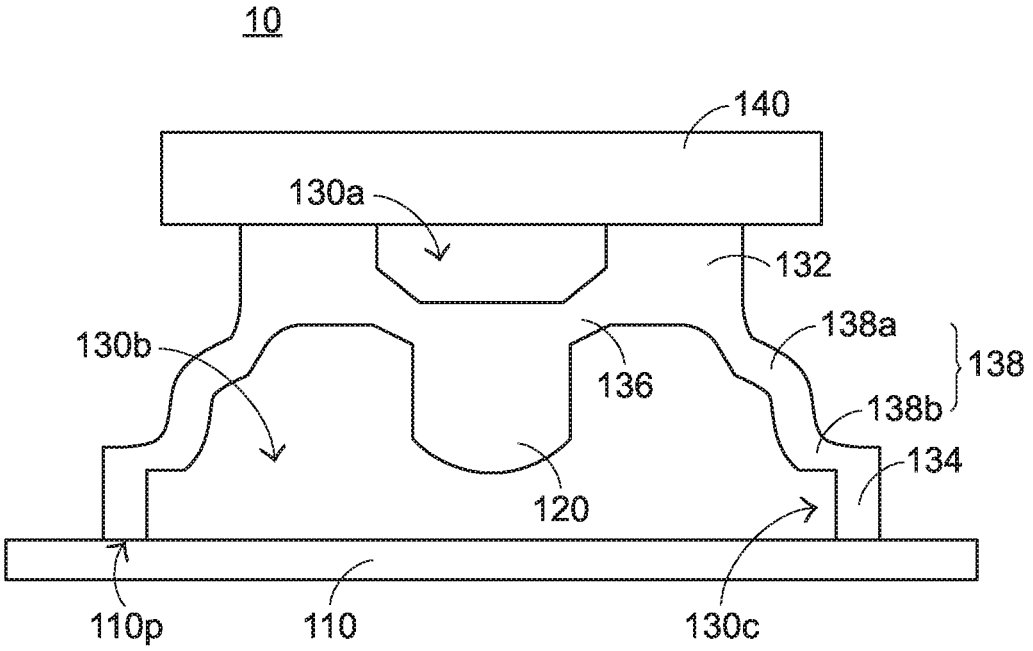

Please refer to FIGS. 2A and 2B. While the keycap 140 is firstly pressed down, the lower space 130*b* is compressed, and the first section 138*a* of the lower elastic portion 138 is subjected to deformation and protruded externally to provide a first stage of the travel distance of the key structure 10. Meanwhile, the second section 138*b* of the lower elastic portion 138 has not undergo obvious deformation, and the upper elastic portion 136 is not subjected to deformation.

Figure 2C:
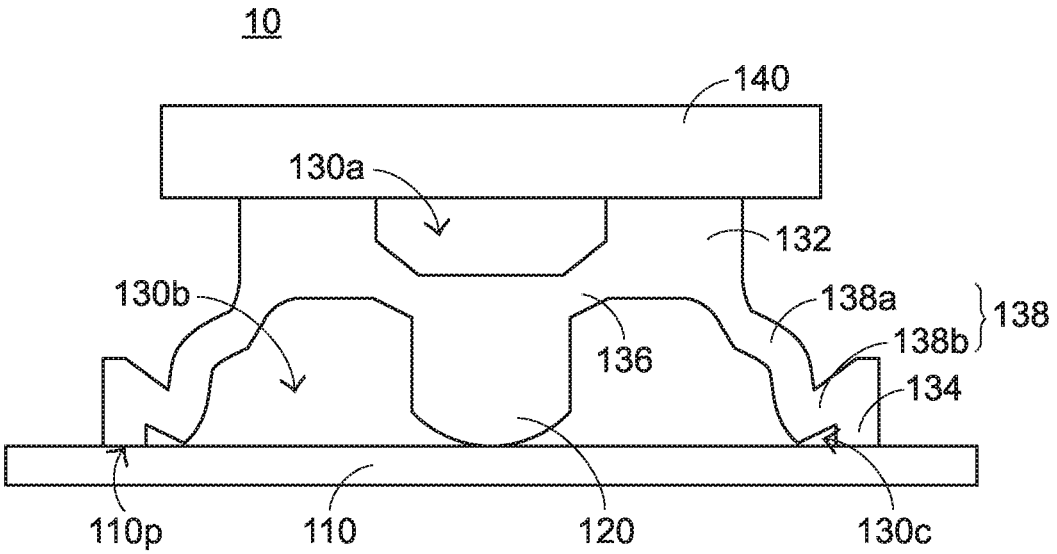

Please refer to FIGS. 2B and 2C. As the keycap 140 is continuously pressed down, the lower space 130*b* is continuously compressed, and the second section 138*b* of the lower elastic portion 138 is subjected to obvious deformation and moved toward the circuit board 110 to provide a second stage of the travel distance of the key structure 10. In this stage, the second section 138*b* of the lower elastic portion 138 is possibly in contact with the circuit board 110. Meanwhile, the upper elastic portion 136 is still not subjected to deformation.

Figure 2D:
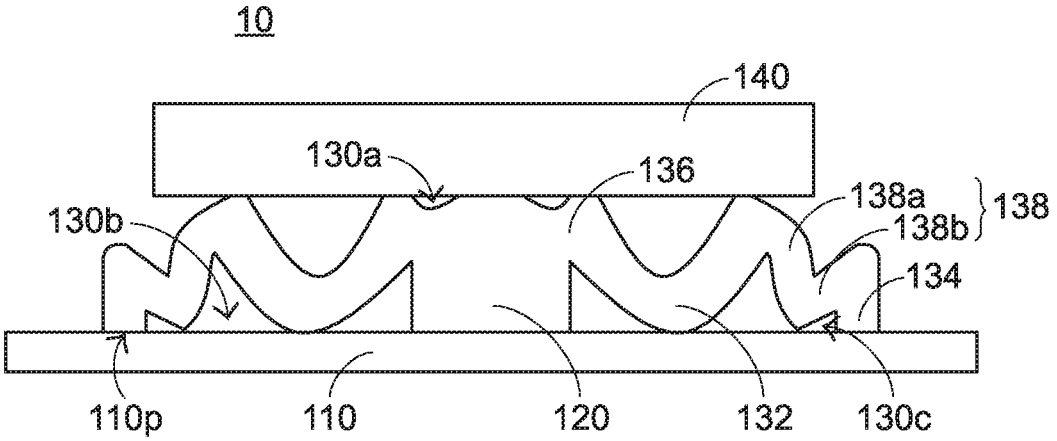

Please refer to FIGS. 2C and 2D. As the keycap 140 is continuously pressed down, the lower space 130*b* is continuously compressed, and the lower space 130*b* is continuously compressed. Consequently, the upper elastic portion 136 is subjected to deformation. Especially, in case that the upper support portion 132 and the triggering part 120 are also subjected to deformation, a third stage of the travel distance of the key structure 10 can be provided.

As mentioned above, the travel distance of the key structure 10 can be provided by the first section 138*a* of the lower elastic portion 138, the second section 138*b* of the lower elastic portion 138 and the upper elastic portion 136. Especially, a portion of the travel distance can be provided by the upper support portion 132 and the triggering part 120. Therefore, the key structure of the present disclosure has sufficient travel distance and touch feeling. From the above descriptions, even if the overall thickness of the key structure 10 or the thickness of the elastic element 13 is very small, the key structure 10 of the present invention can provide the sufficient travel distance. In other words, the key structure 10 of the present invention can meet today's requirements.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a circuit board comprising a switch and a peripheral region, wherein the peripheral region is located adjacent to the switch;

a triggering part aligned with the switch; and an elastic element comprising an upper support portion, a lower support portion, an upper elastic portion and a lower elastic portion, wherein the lower support portion is located beneath the upper support portion, and connected to the peripheral region of the circuit board, wherein the upper elastic portion is connected between the triggering part and the upper support portion, and the lower elastic portion is connected between the upper support portion and the lower support portion, wherein the lower elastic portion comprises a first section and a second section connected to each other, and an angle between the first section and the second section is larger than 120 degrees and smaller than 180 degrees, wherein the first section is connected to the upper support portion, and the second section is connected to the lower support portion, and there is a vacant space between the second section and circuit board.

2. The key structure according to claim 1, wherein an upper space is defined by the triggering part, the upper elastic portion and the upper support portion collaboratively, and a lower space is defined by the triggering part, the upper elastic portion, the first section of the lower elastic portion, a bottom surface of the second section of the lower elastic portion and an inner surface of the lower support portion collaboratively.

3. The key structure according to claim 1, wherein an angle between the upper elastic portion and the lower elastic portion is larger than 45 degrees and smaller than 90 degrees.

4. The key structure according to claim 1, wherein the lower elastic portion is thinner than the upper elastic portion.

5. The key structure according to claim 1, wherein the first section of the lower elastic portion is thinner than the second section of the lower elastic portion.

6. The key structure according to claim 1, wherein an angle between the second section of the lower elastic portion and the lower support portion is larger than or equal to 90 degrees and smaller than 180 degrees.

7. The key structure according to claim 2, wherein the key structure further comprises a keycap, wherein while the keycap is pressed down, the lower space is compressed, and the first section of the lower elastic portion is subjected to deformation and protruded externally.

8. The key structure according to claim 1, wherein the key structure further comprises a keycap, wherein while the keycap is pressed down, the second section of the lower elastic portion is subjected to deformation and moved toward the circuit board.

9. The key structure according to claim 1, wherein a first end of the upper elastic portion is connected to the upper support portion, and a second end of the upper elastic portion is connected to the triggering part, wherein the first end of the upper elastic portion is thicker than the second end of the upper elastic portion.

10. The key structure according to claim 1, wherein there is a distance between the second section of the lower elastic portion and the circuit board, and a ratio of the distance to a length of the second section is in a range between 1:4 and 2:1.

11. The key structure according to claim 1, wherein both of the first section and the second section of the lower elastic portion are linear.

* * * * *